United States Patent [19]

Wissing

[11] Patent Number: 4,792,147

[45] Date of Patent: Dec. 20, 1988

[54] MECHANICS CREEPER

[76] Inventor: Robin F. Wissing, P.O. Box 904, Fairburn, Ga. 30213

[21] Appl. No.: 191,418

[22] Filed: May 9, 1988

Related U.S. Application Data

[63] Continuation of Ser. No. 18,047, Feb. 24, 1987, abandoned.

[51] Int. Cl.[4] ..... B25H 5/00

[52] U.S. Cl. ..... 280/32.6; D34/23

[58] Field of Search ..... 280/32.5, 32.6, 79.1 R, 280/79.1 A, 87.02 R, 11.1 R, 11.115; D34/23; 16/38, 39, 30

[56] References Cited

U.S. PATENT DOCUMENTS

| | | | |
|---|---|---|---|
| 152,008 | 12/1848 | Lucas | D34/23 |
| 242,909 | 1/1877 | Miller | D34/23 |
| 1,350,929 | 8/1920 | McCarthy | 280/87.04 R |
| 1,420,101 | 6/1922 | Herrick | 280/32.6 |
| 2,124,389 | 7/1938 | Woelfer, Jr. | 280/32.6 |
| 2,246,628 | 6/1941 | Heckman | 280/32.6 |
| 2,291,094 | 7/1942 | McCarthy | 362/61 |
| 2,750,198 | 6/1956 | Moore et al. | 280/71.4 |
| 4,167,271 | 9/1979 | Jorgensen | 280/79.1 R |
| 4,185,846 | 1/1980 | Black | 280/32.6 |
| 4,570,957 | 2/1986 | Rose | 280/32.6 |

FOREIGN PATENT DOCUMENTS

| | | |
|---|---|---|
| 40177 | 5/1929 | Denmark . |
| 841028 | 4/1952 | Fed. Rep. of Germany . |
| 963389 | 7/1964 | United Kingdom . |

*Primary Examiner*—David M. Mitchell
*Assistant Examiner*—Richard Camby
*Attorney, Agent, or Firm*—Mallinckrodt & Mallinckrodt

[57] ABSTRACT

A mechanics creeper has a molded body shell with upturned peripheral edges or walls forming a receiving area within the walls for receiving the head and torso of a user. Wheels are mounted on the body shell so that the shell can easily roll over various types of surfaces with the upturned peripheral walls protecting the user from water, mud, or other materials and from striking unseen objects as the creeper is moved. The wheels may be removable so that the body shell, having a smooth outside contour, may slide over surfaces such as mud, sand, or snow, or through rubble were wheels are unuseable.

8 Claims, 2 Drawing Sheets

MECHANICS CREEPER

This is a continuation of application Ser. No. 018,047, filed 2/24/87, now abandoned.

BACKGROUND OF THE INVENTION

1. Field

This invention related to devices commonly known as mechanics creepers.

2. State of the Art

Mechanics have utilized mechanics creepers for many years in order to easily move around and work under automobiles, other vehicles, or in other locations having a limited space between the object and the ground. The creeper typically includes a flat, or nearly flat, body equipped with small casters mounted under the body, wherein the body is supported several inches above the floor. The mechanic lies on the creeper and the casters allow the mechanic to move the creeper around by pushing with his feet or hands on the floor.

The prior art is typified by the devices shown in U.S. Pat. Nos. 1,420,101; 2,124,389; 2,291,094; 4,185,540; and U.S. Pat. No. Des. 152,008.

In general, the prior art devices are designed to operate on smooth surfaces such as garage floors. The usual small caster wheels used make it very difficult to operate the device over rough terrain or on grass, or in mud or snow. Even on concrete floors, the casters fall into and get stuck in the trowl or other joints between concrete slabs. Furthermore, the casters are permenantly mounted and are not designed for removal.

In addition, these prior art devices provide little, if any, protection to the body and clothes of the user when operated in shallow water or snow or mud. Likewise, they provide little, if any, protection to the body or head of the user against striking objects in the path of travel of the device.

SUMMARY OF THE INVENTION

According to the invention, a mechanics creeper includes a molded body shell with upturned peripheral edges forming peripheral walls which define a torso and head receiving area or recess within the walls to receive and support the torso and head of a user. As used herein, the torso is considered to include the hips and above of a user's body. The top of the walls will preferably extend at least about four to six inches above the bottom of the shell to protectively surround the periphery of the user and the shell is preferably contoured to comfortably receive the user's body. A plurality of wheel means are removably mounted to the molded body shell to support the shell above the ground for rolling movement over the ground. The diameter of the wheels are larger than the clearance between the ground and the bottom of the shell and preferably are at least between about four to six inches in diamter so that the wheels will easily roll over rough terrain. In normal situations, the bottom of the shell will be supported about one inch above the ground by the wheels. The wheels are easily removable from the shell by a user and the shell has a smooth exterior contour so that with wheels removed, it will easily slide over materials such as mud or snow or over rubble where wheels would be unuseable, or with or without wheels, will act somewhat as a boat in shallow water.

It is an object of the present invention to provide a device which will roll easily over various surfaces including rough or soggy surfaces such as grass, gravel, or earth, and from which the wheels may be easily removed by a user so that the device will slide without projecting wheels over surfaces such as snow, mud, sand, and rubble.

It is a further object of the present invention to provide a device so constructed that it protects the body and clothing of the user against any mud, snow or water that may be present around the creeper.

It is a still further object of the invention to provide a device having wheels larger than normally used on similar devices and which are easily removable and replaceable so that the device can be used with or without wheels or so that the wheels used can be selected to be most suited to a particular use of the device.

THE DRAWINGS

In the accompanying drawings, which illustrate the best mode presently contemplated for carrying out the invention:

FIG. 1 is a perspective view of a mechanics creeper of the invention looking from the side of the creeper;

FIG. 2, a side elevation of the creeper of FIG. 1;

FIG. 3, a perspective view of the creeper taken from the rear of the creeper;

FIG. 4, a fragmentary vertical section taken on the line 4—4 of FIG. 2 drawn to a larger scale and showing a wheel assembly and mounting means and having the proportions of the mounting means exagerated in relation to the wheel for purposes of illustration;

FIG. 5, a perspective view of the creeper with wheels removed, a user therein, and showing the creeper sliding over a rubble strewn surface; and FIG. 6, a perspective view of the creeper with wheels removed strapped to the back of a user.

DETAILED DESCRIPTION OF THE ILLUSTRATED EMBODIMENT

Figure 1:
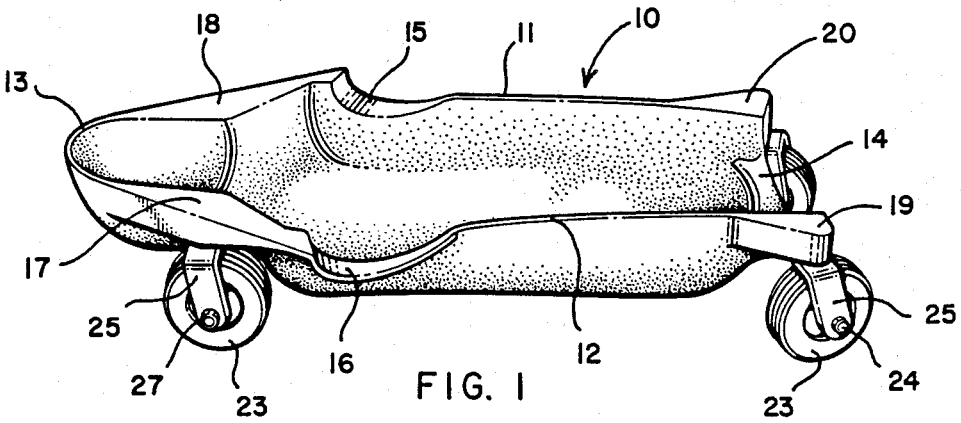
Figure 2:
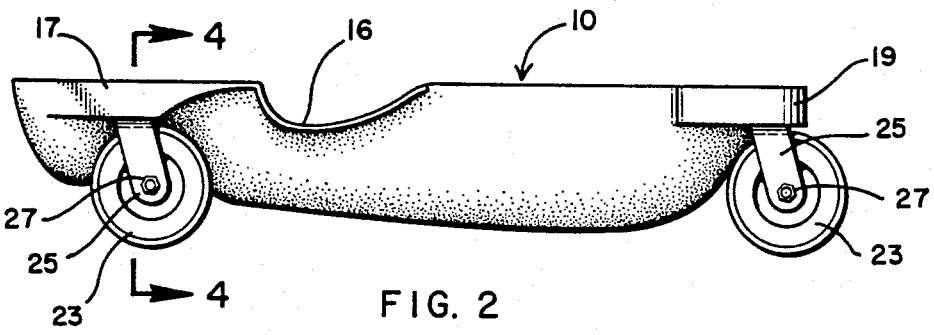
Figure 3:
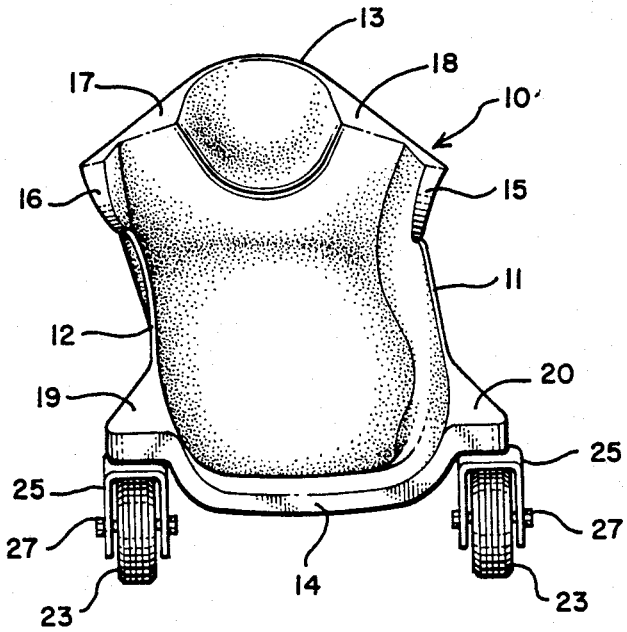

In the illustrated embodiment of the invention, a mechanics creeper has a molded, form-fitting body shell 10. The peripheral edges of the body shell 10 are upturned to form a continuous peripheral wall indicated as side walls 11 and 12, front wall 13 and rear wall 14. The shell may be made of various materials with a plastic or fiberglass material presently preferred.

As illustrated, the side and front peripheral walls extend above the bottom of the body shell to partially enclose a user lying in the shell. The rear wall 14 is lower than the other walls to allow a user's legs to comfortably extend therefrom, but, as shown, extends to some extent above the bottom of the shell. Lowered arm areas 15 and 16 in side walls 11 and 12, respectively, provide an area for comfortable extension of the arms of a user when lying in the shell.

Figure 4:
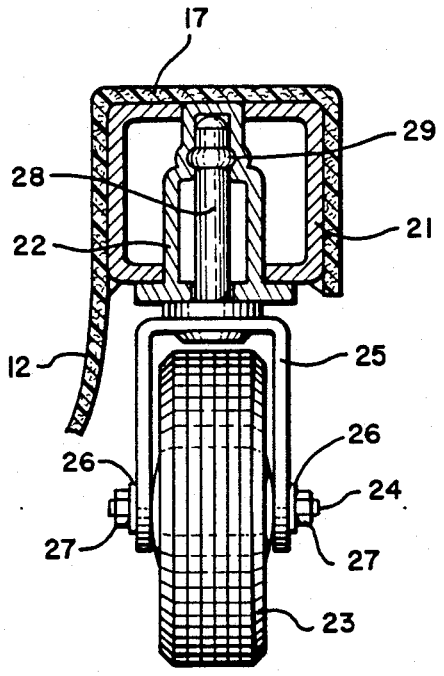

Molded into the tops of the upper side walls 11 and 12 at the front and rear of such walls are wheel mounting areas 17, 18, 19, and 20. These provide an area where wheel means may be mounted to the body shell. While many types of wheel mounting means may be used, as illustrated, the body shell mounting area may be molded to form a receiving channel as shown in FIG. 4 which will accept by close friction fit with glueing if necessary, or by any other means of securement, a wheel bracked support 21 such as a length of aluminum tubing with a standard wheel caster stem socket 22 secured therein.

Wheels 23 are mounted for rotation on axles 24 which are threaded at their ends and held in castering forks 25 by washers 26 and axle bolts 27. A standard caster stem 28 is mounted at the top of each fork 25 and may be easily slipped in and out of caster stem socket 22, FIG. 4. When in place in a socket 22, the caster stem and wheel 23 is held in place by an expansion ring 29. When a wheel is to be removed, a user merely has to pull the wheel and caster stem out of the securing socket. No tools are required for such removal. As shown, caster stem 28 is offset in normal manner from axle 24 so that the wheels 23 will easily caster or turn as the creeper is pushed so that the creeper may be easily manuevered by a user.

With the walls extending up from the bottom of the shell and with the wheels mounted at the top of the walls, larger diameter wheels than normally used with mechanics creepers can be used to provide better rolling of the creeper over rough or soggy surfaces. The size of the wheels should be at least about four inches in diameter and generally will be larger. Wheels six inches in diameter have been found to allow the creeper to roll easily over most rough, gravelly, or soggy surfaces. Also, the wider the wheels the better support they provide and the easier they roll over soft or soggy surfaces. A wheel width of about two inches has been found satisfactory. Since it is desired to use wheels as large as possible, the mounting for the wheels, when placed above the wheels, as shown, should be as narrow as possible to still provide the strength necessary for wheel mounting and should be located as high as possible, preferably flush with the top of the side walls, as shown, to allow as much height as possible for the wheels between the bottom of the mounting and the surface over which the shell is to be supported at its desired height above the surface. In this way, the diameter of the wheels can be maximized while still allowing a preferred caster type mounting of the wheels to provide easy manueverability. With such mounting, the diameter of the wheels will be greater than one half the distance from the surface over which the shell is supported to the top of the peripheral edges or walls of the shell.

For normal work, the wheels will generally be sized to support the creeper body shell at its lowest point about one inch above the ground. However, since the wheels are removable, larger wheels may be inserted for special uses such as working over extremely rough ground on construction or farm equipment which provide more ground clearance than the normal automobile and where larger wheels, such as twelve inch diameter wheels, may be used to provide easy rolling over the rough ground.

Figure 5:
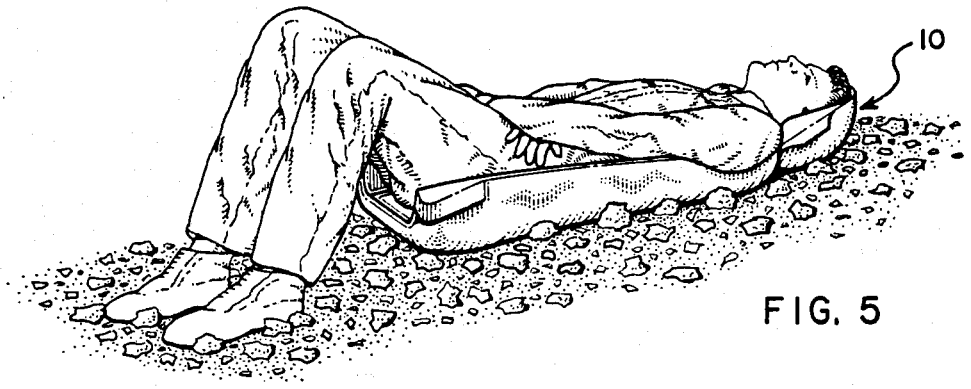

Also, since the wheels are removable, the creeper body shell may be used without the wheels. The body shell is smoothly contoured on its outer surface so that it will act as a sled or boat for use without wheels in movement over mud and snow where wheels would merely stick into the mud or snow and prevent movement of the creeper body shell. The smooth contour of the body shell without flanges or sides extending downwardly to an extent to stick into or collect the mud or snow is important for easy passage over such surfaces. Further, without the wheels, as shown in FIG. 5, the shell can be easily moved over surfaces covered with rubble such as building crawl spaces which may have piles of broken stones or bricks which must be maneuvered over. In such instances, wheels would merely get stuck in the rubble and prevent movement of the body shell. Some flanges such as those provided for mounting the wheels, or a rolled edge at the top of the walls for increasing the strength of the body shell, may extend from the upper portion of the walls, but do not generally extend downwardly to the extent to stick into and collect mud or snow. These flanges, however, should be kept as high on the shell as possible.

The side and front walls of the creeper shell extend upwardly from the bottom of the shell a sufficient distance to partially enclose the user. These walls will generally be such that, as shown in FIG. 5, they extend upwardly to enclose at least about one half the depth of the user when lying in the shell. It has been found that walls extending a height of six inches above the bottom of the body shell are satisfactory in most instances with the rear wall 14 on which the legs rest being about four inches and the lowered areas about the arms also being about four inches. With wheels supporting the creeper body shell about an inch above the ground, the walls will keep a user dry in up to about five inches of water. Without the wheels, the walls will keep the user dry in up to at least about four inches of mud or snow, and since mud or snow does not flow easily, it will generally protect the user in even greater depths.

In addition to protecting the user from water, mud, or snow, the walls will protect the user from objects such as rocks extending from the ground or items placed on the ground which the user cannot easily see and avoid as he is maneuvering the creeper into a desired location. Any object encountered will hit the walls rather than the user. Thus, in FIG. 5, the user is protected from various pieces of rubble hitting his head as he slides along over it. In normal use as a mechanics creeper, the walls will prevent the user's body from hitting large tools resting on the floor over which the creeper is moved and the larger than normal wheels will generally allow the creeper to roll over at least the smaller tools, such as wrenches or screwdrivers, which would stop the normal creeper.

Figure 6:
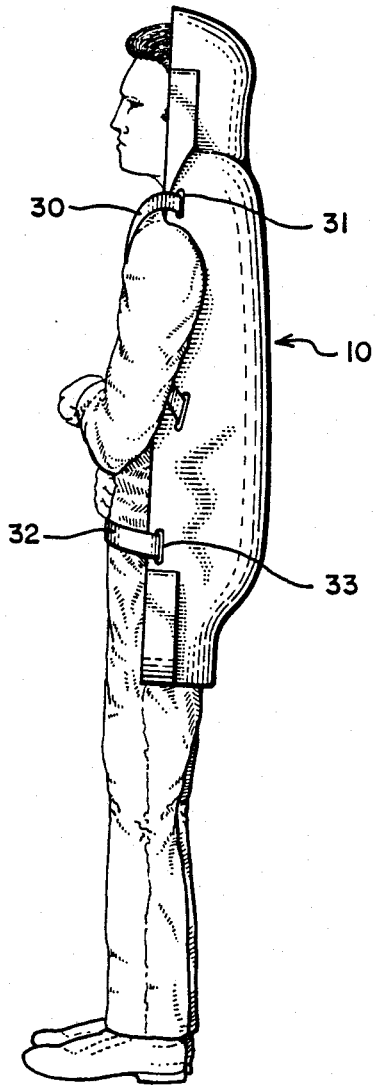

Because of the creeper shell's form fitting configuration, the shell may be provided with straps 30, FIG. 6, secured to the shell in any suitable manner such as by passing the ends thereof through slots 31 in the body shell provided for that purpose. The straps 30 fit about the shoulders of a user, as shown, in a manner similar to back pack straps and with a belt 32 secured in suitable manner such as passing through slots 33, the creeper is held in position on a user's back as shown. This enables a user to perform work, get supplies, and move around in a normal upright position but to quickly lie down and slide under a vehicle for repair work. This fast action is useful during various type of auto racing. The creeper can be used in this manner with or without wheels mounted depending upon the surface on which it is to be used.

While the creeper body shell is shown with reduced height walls where the legs extend therefrom and the arms extend, the wall could be made the same height all of the way around the creeper and the walls could be made higher than shown to enclose more of the user, if desired. In such instances, enlarged areas within the walls may be provided about the arms to allow easy movement of the arms. The legs can extend over the higher walls by additional bending of the legs.

Further, while four wheels are shown supporting the body shell, three wheels could be easily used and the mounting positions could be changed. In addition, various means for mounting the wheels in addition to that shown could be used. The important aspect in mounting the wheels is that they be mounted so that wheels of larger diameter than usually used are provided. Also, it is preferred that the wheels are mounted so that they may be easily and conveniently removed or replaced by the user.

Whereas this invention is here illustrated and described with specific reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A mechanics creeper, comprising a molded, smoothly contoured body shell with upturned peripheral edges curving smoothly upwardly from the bottom of the shell and terminating above the bottom of the shell, the peripheral edges extending upwardly from the bottom of the shell at least half the depth of a user lying therein and extending protectively about the lower periphery of the user's head and torso; a plurality of wheel mounting means for removably mounting wheel means to the body shell, said mounting means positioned so that wheel means mounted thereby will have their wheels located outwardly of the upturned peripheral edges of the body shell and so that with wheel means mounted, the body shell is completely supported by said wheel means above the surface upon which the wheel means rest for rolling movement over said surface and without the wheel means mounted, the body shell is free to slide, by reason of its smoothly contoured molded body and smoothly upwardly curved peripheral edges, over or through the material upon which it rests.

2. A mechanics creeper according to claim 1, wherein the peripheral edges form a recess for receiving the torso and head of a user which is contoured to fit the user's form when the user lies therein.

3. A mechanics creeper according to claim 1, wherein the walls extend upwardly a distance of at least about four inches above the bottom of the shell.

4. A mechanics creeper according to claim 1, including wheel means with wheels wherein the diameter of the wheels is at least four inches.

5. A mechanics creeper according to claim 4, wherein the diameter of the wheels is six inches.

6. A mechanics creeper according to claim 1, wherein strap means are provided to strap the creeper to the user so that the creeper remains in place with the user as he stands upright and moves around.

7. A mechanics creeper according to claim 6, wherein the strap means include shoulder straps mounted to the creeper shell.

8. A mechanics creeper according to claim 7, wherein the strap means further includes a belt mounted to the creeper shell.

* * * * *